United States Patent [19]

Shrum, Jr.

[11] Patent Number: 4,683,988

[45] Date of Patent: Aug. 4, 1987

[54] MULTI-STAGE HYDRAULIC DRIVE SYSTEM

[76] Inventor: William M. Shrum, Jr., 13007 S. Main St., Los Angeles, Calif. 90061

[21] Appl. No.: 782,800

[22] Filed: Sep. 27, 1985

[51] Int. Cl.[4] ..... B66B 9/20

[52] U.S. Cl. ..... 187/9 E; 414/630

[58] Field of Search ..... 187/17, 9 E, 9 R, 94; 414/629, 630, 631; 92/146, 117 R, 117 A

[56] References Cited

U.S. PATENT DOCUMENTS

| | | | |
|---|---|---|---|
| 2,821,264 | 1/1958 | Ulinski | 187/9 E |
| 3,276,549 | 10/1966 | Ramsey | 187/9 E |
| 3,534,664 | 10/1970 | Ulinski | 187/17 |
| 4,219,302 | 8/1980 | Leskovic | 187/9 E |
| 4,357,994 | 11/1982 | Hall | 187/17 |
| 4,363,380 | 12/1982 | Rued et al. | 187/17 |

*Primary Examiner*—Joseph J. Rolla
*Assistant Examiner*—Kenneth Noland
*Attorney, Agent, or Firm*—Jessup, Beecher & Slehofer

[57] ABSTRACT

A hydraulic drive system has a pair of cylinder/piston assemblies cascaded together and interfaced by a frame. The two assemblies are parallel, but not co-axial, so that in retracted position they may reside side-by-side, thereby minimizing the longitudinal space required to accommodate the system when in retracted position. Lateral torque resulting from the offset between the axes of the two cylinder/piston assemblies is resisted by causing the interfacing frame to slide against and ride between a pair of longitudinal rails, which resist the lateral forces resulting from the torquing of the frame.

4 Claims, 4 Drawing Figures

MULTI-STAGE HYDRAULIC DRIVE SYSTEM

BACKGROUND OF THE INVENTION

1. Field of the Invention

This invention relates to hydraulic drive systems and particularly such systems as are used in raising and lowering platforms, cages, and the like. More particularly, it relates to a hydraulic drive system in which a plurality of cylinder/piston assemblies are cascaded together so as to decrease the total length occupied by the system when it is in retracted, or in the case of an elevator, lowered position.

2. Description of the Prior Art

When two or more cylinder/piston elevator arrangements or systems are cascaded so as to minimize the length of the system when in retracted or lowered position, the systems must be laterally displaced with respect to each other in order to achieve the shortening effect desired. This lateral displacement produces non-aligned forces on the system which result in torque about a horizontal axis which must be accommodated one way or another.

One way of doing this is to balance the pistons so that there are, for example, two cylinder/piston systems side-by-side on opposite sides of a central axis. This has the disadvantage of requiring an extra cylinder/piston assembly.

Unless such balance is achieved, it is necessary to make each component sufficiently large and strong that it can withstand the bending moment created by the offset pistons. Strengthening the cylinder/piston structure is not only expensive, since precisely machined parts must be accommodated, but it also subjects these parts to lateral forces which make sealing between piston and cylinder more difficult.

SUMMARY OF THE INVENTION

In accordance with the present invention, the lateral torquing resulting from the offset between two cascaded cylinder/piston assemblies is resisted by longitudinal rails, one at each side of the assembly, in which the assembly slides. The lateral forces resulting from the torquing are resisted by the rails, which may be buttressed by strong, relatively inexpensive structural members forming part of the standard or frame in which the system reciprocates.

DESCRIPTION OF THE PREFERRED EMBODIMENT

Figure 1:
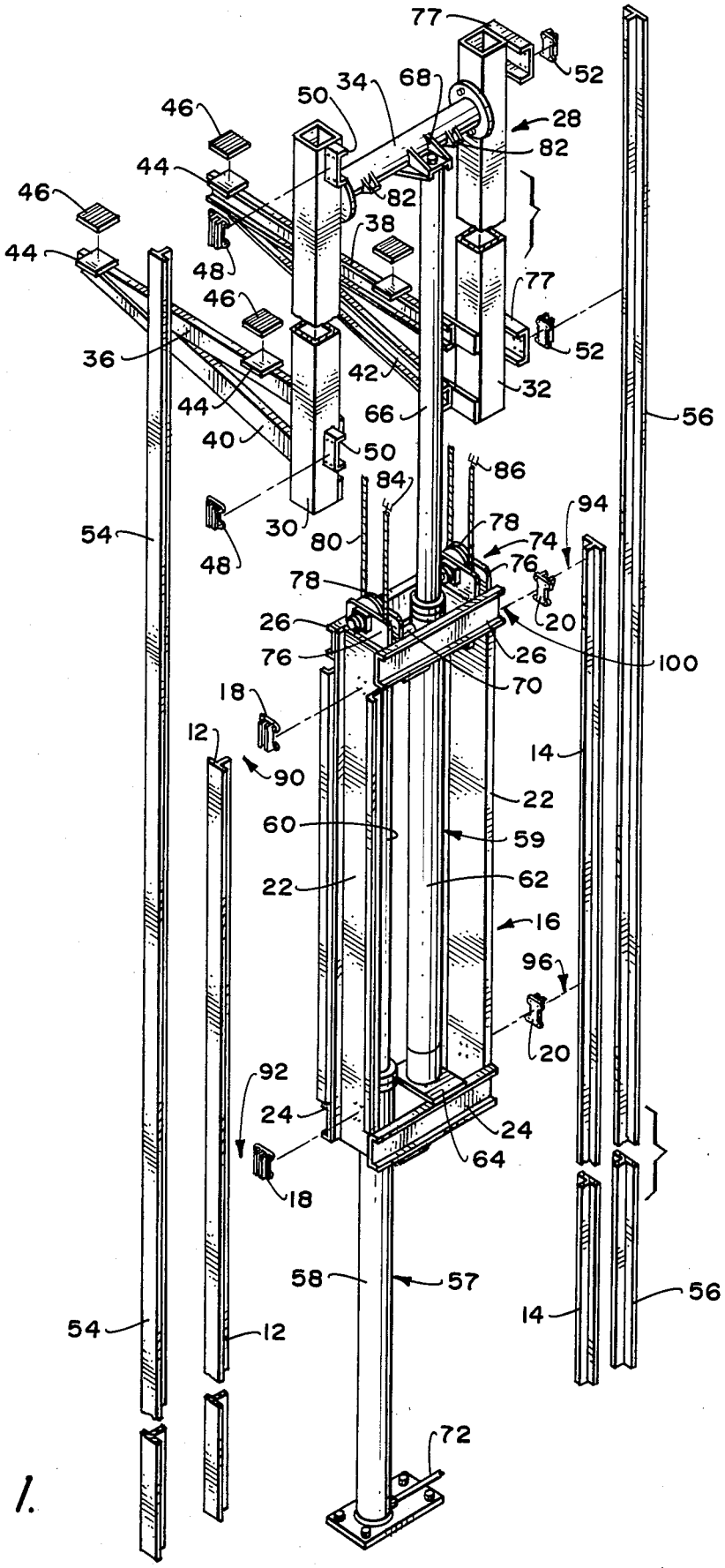
FIG. 1 is a perspective view of the hydraulic drive system of the present invention, partially exploded in the interest of clarity.
Figure 2:
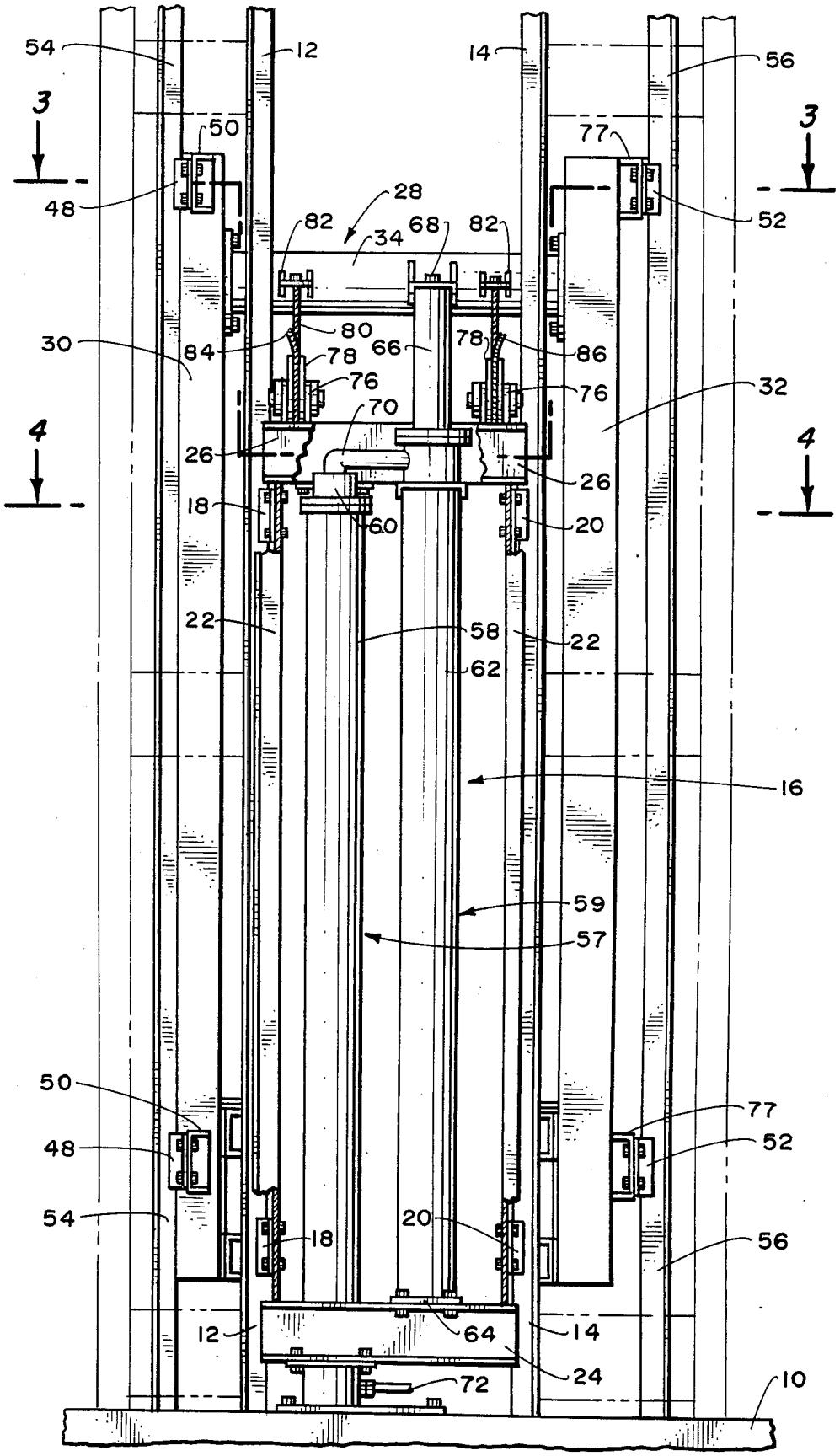
FIG. 2 is a front elevational view of the system in lowered or retracted position.

The hydraulic drive system of the present invention is illustrated in the form of an elevator system having a stationary base or standard 10, such as the floor of the pit in while the elevator is mounted. The system includes a pair of longitudinal, parallel, vertical rails 12 or 14 of T cross-section positioned between the rails 12 and 14, to slide vertically up and down along the rails, is a rectangular frame 16, to which are secured four channel members 18 and 20, two at each side. The channel members 18 bracket the T-rail 12 and form a sliding engagement between the frame 16 and the rail 12. Similarly the channel members 20 bracket the T-rail 14 and effect a sliding engagement with that rail. The members 18 and 20 serve to guide the frame 16 up and down along the rails 12 and 14, and transmit lateral, horizontal load from the frame 16 to the rails 12 and 14.

The frame 16 is comprised of a pair of vertical side channel plates 22. Spanning the bottom edges of the plates 22 are a pair of horizontal channel members 24. Spanning the upper ends of the plates 22 are a pair of upper horizontal channel members 26. The guide channel members 18 are secured to the base of the left channel plate 22 and the guide channel members 20 are secured to the right channel plate 22.

The function of the hydraulic drive of this invention is to raise and lower a carrier 28, consisting of a pair of rectangular posts 30 and 32 connected together by a cylindrical beam 34. Extending from the respective posts 30 and 32 in a direction transverse to the plane of the rails 12 and 14 are cantilevered arms 36 and 38, braced at 40 and 42, respectively, and carrying pads 44. Atop the pads 44 are shock absorbing cushions 46, on which rests an elevator cage of any suitable form or configuration (not shown).

Secured to the post 30 are a pair of guide channels or shoes 48 generally similar to the channels 18 and 20, such securement being throught he intermediacy of a short channel plate 50 secured near the top and bottom respectively of the post 30. In similar fashion, the post 32 is provided top and bottom with a pair of guide channels or shoes 52, through the intermediacy of short channels 77.

The channels 48/52 could engage and be guided by the respective rails 12 and 14, but is is preferred to provide separate T-rails 54 and 56 along which the channels 48 and 52 slide.

A first hydraulic means comprising a cylinder/piston assembly 57 operating between the base 10 and the frame 16 serves to move the frame 16 vertically up and down, running along and between the rails 12 and 14. A second hydraulic means comprising a cylinder/piston assembly 59 operating between the frame 16 and the carrier 28 serves to move the carrier up and down along and between the second vertical pair of rails 54 and 56.

The first cylinder/piston assembly 57 has one of its members, in this case the cylinder 58, secured upright to the base 10 and extending upwardly through the gap between the horizontal frame members 24. Sliding in the cylinder 58 and extending upwardly therefrom is the piston 60, the upper end of which is secured to the upper end of the frame 16.

The second cylinder/piston assembly 59 has one of its members, in this case the cylinder 62, secured upright to a cross plate 64 spanning the lower horizontal channel members 24 of the frame 16. The cylinder 62 extends upwardly through the space between the cross members 26. In the cylinder 62 slides a piston 66, the upper end of which is secured to a plate 68 extending radially from the cylindrical cross beam 34 of the carrier 28.

Both pistons 60 and 66 are hollow and piston 60 is open at the bottom end. At the upper end of piston 60 is a cap which has an L-fitting pipe 70, that communicates hydraulic fluid from the piston 66 over to the cylinder 62. Hydraulic fluid under pressure is admitted to the interior of the lower cylinder 58 by a conduit 72. This fluid fills the cylinder 58, the hollow piston 60, the transfer pipe 70, the cylinder 62 and the piston 66. The lower end of the piston 66 is capped to prevent entry of hydraulic fluid and the upper end is secured to the anchor plate 68.

The pressure of the hydraulic fluid exerts an upward force on the piston 60 and hence on the frame 16, causing the frame to slide upwardly in the rails 12 and 14. Similarly the pressure in the piston 66 causes the carrier 28 to slide upwardly, with respect to the frame 16, in its rails 54 and 56. Thus the application of pressure brings about a compound raising of carrier 28, half of the raising being achieved by an elevation of the frame 16 with respect to the base 10, the other half being achieved by the raising of the carrier 28 with respect to the frame 16.

Pressure in the cylinder 58 must overcome the weight of carrier 28 as well as the frame 16. The same pressure in the cylinder 62 encounters only the weight of the carrier 28. Thus, without more, the application of pressure would raise the carrier in two phases. In the first phase, the frame 16 would remain stationary at the bottom, while all the action would take place in the extending of the piston 66. At this point pressure would build up sufficiently to overcome the added weight of the frame 16, and the frame 16 would then rise, raising before it the entire assembly consisting of the frame 16 and the carrier 28.

It is desirable that the raising action be evenly distributed at all times, so that the velocity of the frame 16 with respect to the base 10 is the same as the velocity of the carrier 28 with respect to the frame 16. This is achieved by a cabling arrangement shown at 74. Spanned between the cross members 26 at the upper end of the frame 16 are a pair of sheave plates 76 between which is journaled a sheave 78. A cable 80 having one end secured at 82 to the beam 34 of the carrier 28 passing downwardly, under the sheave 78, and then up to a fixed anchor point located in the fixed framework of the elevator system, above the highest point that the carrier 28 would reach. This is shown symbolically at 84. For balance, a similar cabling arrangement is shown at 86 at the opposite side of the frame 16. This arrangement causes the piston 66 to share the load of the frame 16 with the piston 60, and assures that the velocity of the frame 16 will be one-half the velocity of the carrier 28.

In the structure above described, the piston 60 imparts an upward force to the frame 16 at one end of the cross members 26 forming a portion of the frame 16. At the same time, the bottom cross members 24 at the other side of the frame 16 feel the downward force of the cylinder/piston assembly 57. These two forces, by virture of the geometry of the structure, are parallel but laterally offset from each other. This produces a torque on the frame 16 about a horizontal axis. Were it not for the rails 12 and 14, this torquing would be transmitted to the piston/cylinder assemblies in the form of severe bending moments, which would require structural strengthening of these members that would not otherwise be required. The slide channels 18 and 22 constitute bearing means interposed between the rails 12 and 14, respective, and the frame 16, which transmit the lateral thrust of the torque onto the rails 12 and 14.

Figure 3:
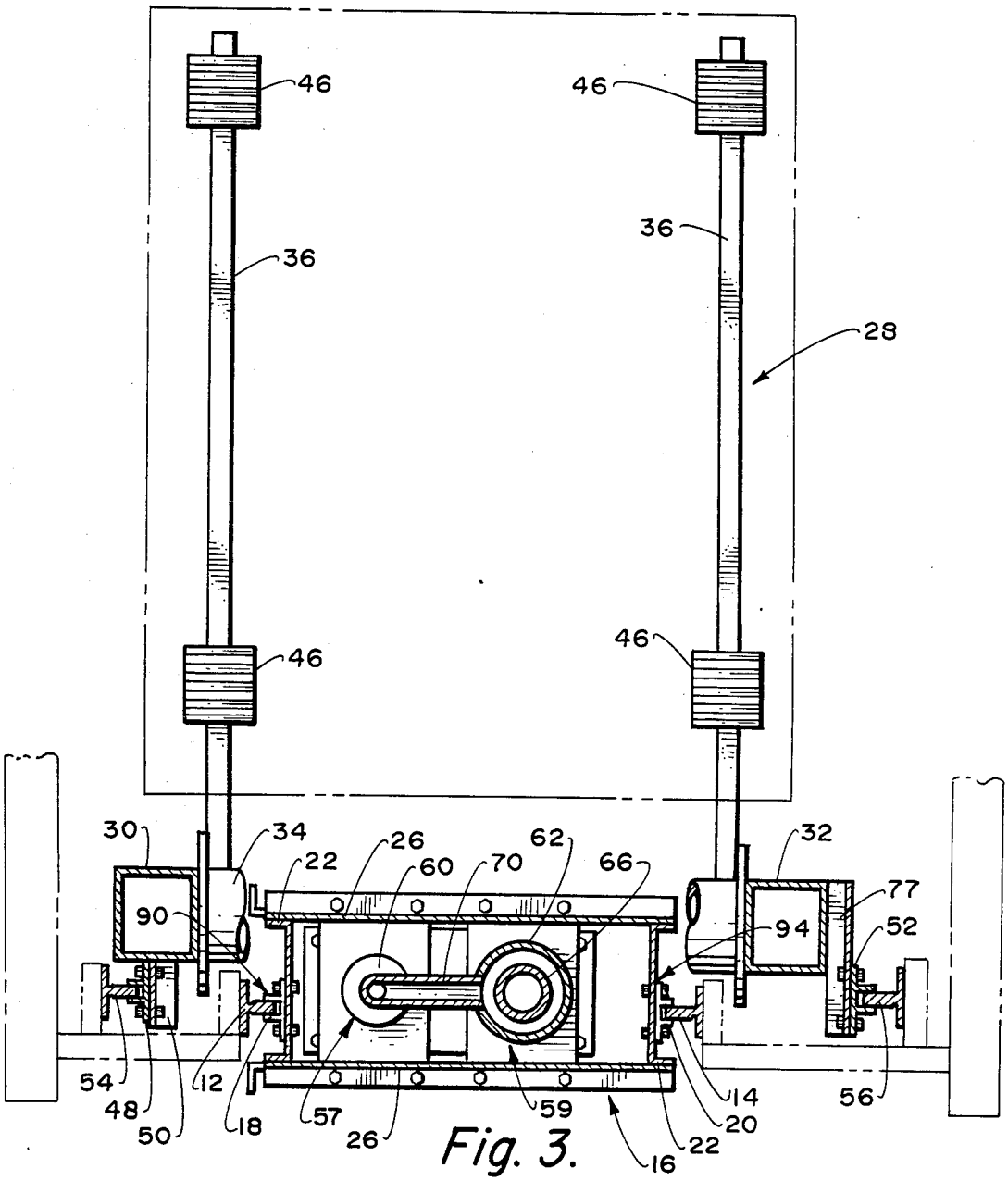
FIG. 3 is a cross section taken on line 3—3 of FIG. 2.
Figure 4:
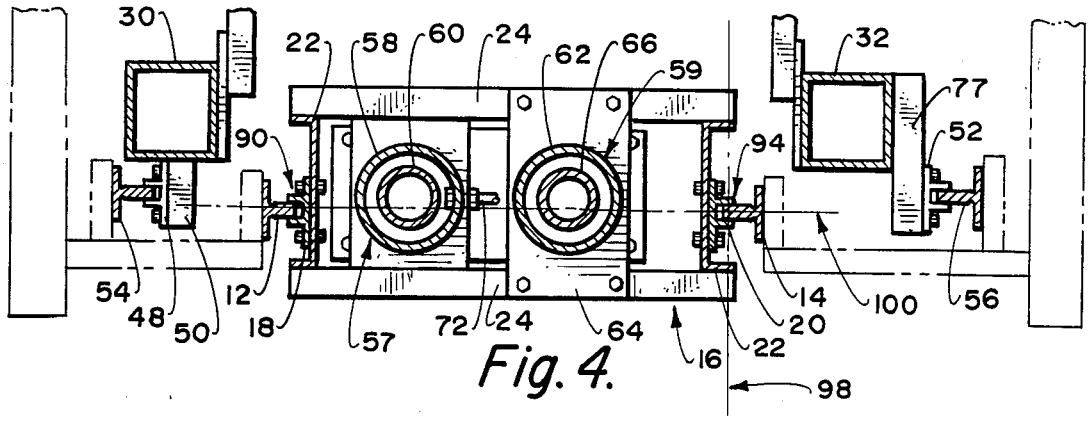
FIG. 4 is a cross section taken on line 4—4 of FIG. 2.

FIGS. 3 and 4 show the structure when it is unloaded and with minimal strain. There are small gaps, as shown at 90 and 92 (FIGS. 1 and 3), between the rail 12 and the channel members 18, and at 94 and 96 between the rail 14 and the channel members 20.

Under load, the torque described above closes the gap at 94, and brings the trough of the upper channel member 20 into sliding contact with the inward facing edge of the rail 14. This contact is on a vertical plane represented by the line 98 in FIG. 4, which is normal to the line 100 (FIGS. 1 and 4) which is transverse to and spans the rails 12 and 14. Simultaneously, the gap at 92 is closed, bringing the trough of the lower channel member 18 into sliding contact with the inward facing edge of the rail 12.

In this way the lateral thrust produced by the torque is resisted and absorbed by the rails 12 and 14.

What is claimed is:

1. Hydraulic drive means comprising:

base means having a pair of longitudinal parallel rails;

frame means movably mounted between said rails for longitudinal reciprocation;

bearing means interposed between said rails and said frame means, providing respective bearing surfaces lying in a plane normal to a line transverse to and spanning said rails, for transmitting lateral thrust along said line from said frame means to said rails;

first hydraulic means consisting of a first pair of members, one being a cylinder and the other being a piston reciprocally mounted therein;

one member of said first pair being mounted to said base means, the other member of said first pair being mounted to said frame means;

a carrier movably mounted between said rails for longitudinal reciprocation;

second hydraulic means consisting of a second pair of members, one being a cylinder and the other being a piston reciprocally mounted therein;

one member of said second pair being mounted to said frame means, the other member of said second pair being mounted to said carrier;

means for flowing hydraulic fluid into and out of said cylinders, thereby to extend and retract the respective said pistons;

the axis of said first pair of members being parallel to and laterally offset from the axis of said second pair of members;

whereby in-flowing of hydraulic fluid into said cylinders effects extension of said pistons from their respective cylinders with consequent longitudinal movement of said frame and said carrier, the lateral offset between the axes of said first and second pair of members creating a lateral torque on said frame means which is transmitted to and resisted by said rails through said bearing means.

2. Drive means in accordance with claim 1, including:

control means operating between said carrier and said frame means for causing said carrier to move at twice the velocity of said frame means.

3. Drive means in accordance with claim 2 wherein said control means comprises:

a sheave journaled on said frame means and;

an elongate flexible member having one end secured to said carrier, the other end fixed with respect to said base means, the intermediate portion there between extending around said sheave.

4. Hydraulic elevating means comprising:

base means having a pair of spaced vertical rails;

frame means moveably mounted between said rails for vertical reciprocation:

bearing means interposed between said rails and said frame means for transmitting horizontal thrust froms aid frame means to said rail;

first hydraulic means consisting of a first pair of members, one being a cylinder and the other being a piston reciprocally mounted therein;

one of said first pair of members being mounted to said base means, the other of said first pair of members being mounted to said frame means;

an elevating carrier moveably mounted for vertical reciprocation parallel to said rails;

second hydraulic means consisting of a second pair of members, one being a cylinder and the other being a piston reciprocally mounted therein;

one of said second pair of members being mounted to said frame means, the other of said second pair of members being mounted to said carrier;

means for flowing hydraulic fluid into and out of said cylinders thereby to elevate and lower said carrier;

the axis of said first pair of members being parallel to but laterally offset from the axis of said second pair of members;

whereby in-flowing of hydraulic fluid into said cylinders effects extension of said pistons from their respective cylinders, with consequent elevating of said frame and said carrier, the lateral offset between the axis of said first and second pair of members creating a horizontal torque on said frame means which is transmitted to and resisted by said rails through said bearing means.

* * * * *